United States Patent [19]

Plagge et al.

[11] 4,435,669

[45] Mar. 6, 1984

[54] ARC TUBE CONSTRUCTION

[75] Inventors: Vernon L. Plagge, East Orange; Ranbir S. Bhalla, Pine Brook, both of N.J.

[73] Assignee: North American Philips Electric Corp., New York, N.Y.

[21] Appl. No.: 36,949

[22] Filed: May 7, 1979

[51] Int. Cl.[3] ..... H01J 17/16

[52] U.S. Cl. ..... 313/634; 313/635; 313/636

[58] Field of Search ..... 313/220, 634–636

[56] References Cited

U.S. PATENT DOCUMENTS

| | | | |
|---|---|---|---|
| 3,450,924 | 6/1969 | Knochel et al. | 313/220 |
| 3,564,328 | 2/1971 | Bagley et al. | 313/220 |
| 3,588,577 | 6/1971 | McVey et al. | 313/317 |
| 3,825,788 | 7/1974 | Pfaue et al. | 313/220 |
| 3,832,589 | 8/1974 | Pfaue | 313/217 |
| 3,832,590 | 8/1974 | Yamazaki et al. | 313/220 |
| 3,886,392 | 5/1975 | Barakitis et al. | 313/220 |
| 4,052,635 | 10/1977 | Jacobs | 313/217 |
| 4,065,691 | 12/1977 | McVey | 313/217 |
| 4,103,200 | 7/1978 | Bhalla | 313/221 |
| 4,198,586 | 4/1980 | Jong et al. | 313/220 |

*Primary Examiner*—David K. Moore

[57] ABSTRACT

An arc tube for a high-pressure sodium (HPS) discharge lamp having an extended seal path to reduce leakage therethrough. The extended seal path is provided by a monolithic arc tube body having circular apertures in the ends thereof of a substantially smaller diameter than the diameter of the arc tube body and a skirted end cap having refractory metal tubulation extending centrally therethrough mounted on each end of the arc tube body. A glassy sealing frit is interposed between the entire interior surface of the end cap and that portion of the refractory metal tubulation extending through the circular aperture in the arc tube ends.

6 Claims, 2 Drawing Figures

ARC TUBE CONSTRUCTION

BACKGROUND OF THE INVENTION

The evolution of the arc tube for the high pressure sodium discharge lamp has involved numerous end closure configurations in an effort to provide a construction for carrying the discharge-sustaining electrodes, provide for the exhausting and filling of the arc tube body and an adequate seal at each end of the arc tube. Of the three, the most difficult has been providing a seal at the ends of the arc tube under the stresses produced by high temperature operation and the attendant expansion and contraction of the end closure parts during operation of the lamp. Most high pressure sodium discharge lamp failures can be attributed to a breakdown in the area of the end closure seal.

It has recently been determined that by operating the high pressure sodium discharge lamp at slightly elevated temperatures, and pressures, that a lamp having significantly improved color rendering properties can be produced. Operating at these slightly higher temperatures places an even greater burden on the end closure seal construction.

Efforts to seal off the ends of the arc tube have included constructions employing enlarged ceramic plugs as disclosed in U.S. Pat. Nos. 3,886,392 and 4,065,691 as well as the combination of ceramic plugs and ceramic end discs as disclosed in U.S. Pat. No. 4,052,635. In other constructions, improved end closures have been provided by the use of refractory metal end caps of the type disclosed in U.S. Pat. No. 4,103,200 with niobium being the preferred refractory metal for the end cap. Seals have also been developed which employ a refractory metal end closure in combination with ceramic parts as for example, those disclosed in U.S. Pat. Nos. 3,450,924; 3,832,589; and 3,825,788.

Although many of these seal constructions have proven to be, in most instances, adequate for normal operation of the high pressure sodium discharge lamp, it is believed that a construction providing a longer continuous seal path will be important in providing longevity to lamps operating at the higher temperatures required for improved color rendition.

SUMMARY OF THE INVENTION

This invention relates to the sealing of the end closure members of a high pressure sodium discharge lamp to the arc tube body and more particularly to providing a longer seal path between the polycrystalline alumina arc tube parts and the refractory metal end closure.

The improved seal of this invention employs an elongated monolithic alumina arc tube body with circular apertures in the ends thereof of a diameter substantially less than the diameter of the arc tube body and a refractory metal end cap having an end portion and an elongated skirt portion which surrounds the sides of the arc tube body adjacent the ends. Refractory metal tubulation extends through the center of the end portion of the end cap and when assembled also extends through the small diameter apertures in the ends of the monolithic arc tube body. The end cap and tubulation is sealed to the ends of the arc tube body by a glassy sealing frit interposed between the internal sides of the skirt portion and end portion of the end cap and that portion of the tubulation extending through the small diameter aperture in the end of the arc tube body. The glassy sealing frit principally comprises alumina and calcia and provides a continuous seal path which extends along the interior surface of the aperture in the end of the arc tube across the end surface of the arc tube body and for a distance around the circumferential surface at the end of the arc tube.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
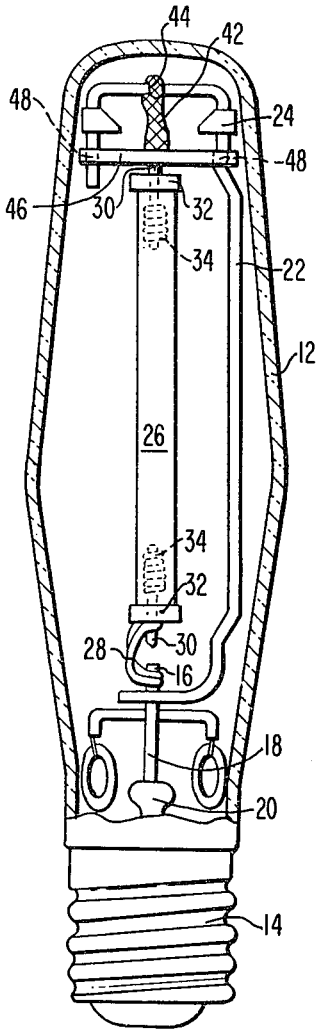
FIG. 1 is a side elevation view partly in section of a high pressure sodium discharge lamp.

Referring now in detail to the drawing wherein like reference characters represent like parts throughout the several views, there is illustrated in FIG. 1 a typical high pressure sodium discharge lamp employing a polycrystalline alumina arc tube. The discharge lamp includes an outer envelope 12 of glass attached to a standard mogul screw base 14. A pair of lead-in conductors 16 and 18 (partially superimposed in FIG. 1) are conventionally connected to the mogul screw base 14 and extend through a reentrant stem press 20 at the base of the envelope 12 in a conventional manner. Mounted on the upper end of the lead-in conductor 18 is the arc tube support frame 22 which serves both to retain and mount the arc tube within the outer envelope 12 as well as to conduct electricity to the upper electrode of the arc tube. The frame 22 is supported at its upper end within the envelope 12 by a pair of resilient spring members 24 which serve to retain the frame 22 in a central location within the outer envelope 12 through resilient contact with the inner surface of the outer envelope.

A conventional polycrystalline alumina arc tube 26 is mounted at its lower end to lead-in conductor 16 by means of a flexible lead wire 28 which encircles the exhaust and fill tubulation 30 of the arc tube and is welded to the lead-in conductor 16 in a manner disclosed in U.S. Pat. No. 3,855,494 for "Ceramic Arc Lamp Construction". The tubulation 30 extends through the end cap 32 at the lower end of the lamp and serves to mount the lower electrode 34 as will be later described. At the other end of the arc tube 26, the arc tube is also closed off by an end cap 32 having exhaust and fill tubulation 30 extending therethrough and carrying a discharge sustaining electrode 34 on the inner end of the tubulation. The tubulation 30 at the upper end of the lamp is electrically connected to the support frame by a flexible strap 42 at 44. The strap 42 is welded to the tubulation 30 and to the lateral support bar 46 at their juncture. The lateral support bar 46 has channels therethrough at 48 which surround the vertical arms of the support frame 22 to provide for centering of the upper end of the arc tube with respect to the frame but in a manner which will permit longitudinal movement or expansion of the arc tube through the loose sliding fit relationship between the support frame 22 and the channels or apertures 48 and the support bar 46.

Figure 2:
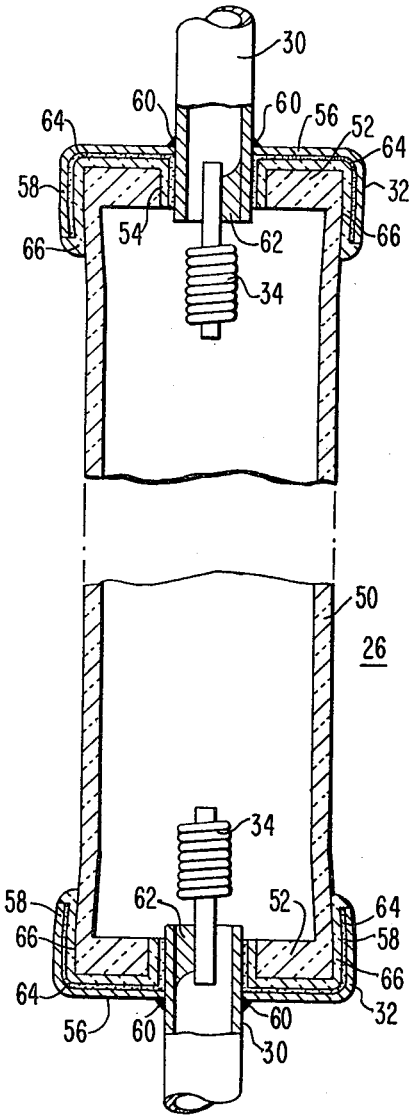
FIG. 2 is a side elevation, partly in section, of the arc tube for a high pressure sodium discharge lamp constructed in accordance with this invention.

Referring now more specifically to the novel arc tube construction of this invention as illustrated in FIG. 2, the monolithic arc tube body includes a tubular central section 50 which has essentially closed ends 52 except for the cylindrical apertures centrally located in the ends 52 at 54. The monolithic arc tube 26 is generally formed in accordance with the teachings of U.S. Pat. No. 3,564,328 to provide the monolithic structure.

The end cap subassembly includes the end cap 32, the tubulation 30, and the discharge-sustaining electrode 34. The end cap includes a flat disc portion 56 with skirt portions 58 and the tubulation 30 is welded or brazed through an aperture in the center of the disc portion 56 as illustrated at 60. The discharge-sustaining electrodes 34 are welded at 62, in a conventional manner, to the inner end of the tubulation 30.

In the preferred embodiment, the end caps and tubulation are preferably niobium and to prepare the end cap tubulation electrode assembly for sealing to the monolithic arc tube, a coating of a slurry of refractory metal powder and silicon metal powder can be provided at 64 on all of the surfaces of the end cap and tubulation which will interface with the arc tube body after assembly to promote bonding, if desired. Such a coating and process is disclosed in copending application Ser. No. 036,948, for "Arc Tube End Seal and Method for Forming", filed by R. S. Bhalla the same day as this application, and owned by the same assignee as this application.

In sealing the end cap, tubulation and electrode subassembly to the monolithic arc tube body, a glassy sealing frit of any one of several well-known kinds can be employed. In almost all instances, the glassy sealing frit principally comprised aluminum oxide and calcium oxide in about euctectic proportions and most of these sealing frits generally include small quantities of other metallic oxides such as silicon dioxide, magnesium oxide, barium oxide, yttrium oxide, etc. Several of these sealing compositions along with the method by which the polycrystalline alumina arc tube is bonded to refractory metal end cap in a high pressure sodium discharge lamp are disclosed in U.S. Pat. No. 3,281,309 to J. F. Ross; U.S. Pat. No. 3,469,729 to R. B. Grekila et al and U.S. Pat. No. 3,588,577 to C. I. McVey et al.

The glassy sealing frit 66 can be applied to the interface between the end cap tubulation assembly and the arc tube body in any one of several methods. The glassy sealing frit can be applied to either or both surfaces before assembly, or rings of the glassy sealing frit can be placed adjacent the bottom edges of the end cap skirt after assembly. Preferably, preformed and prepressed rings of the glassy sealing frit are placed between the end portions 52 of the arc tube body and the flat portion 56 of the end cap 32. With the prepressed glassy sealing frit rings assembled between the end caps and the ends of the arc tube body, the end caps are then sealed to the arc tube body by employing a conventional heating schedule of the type disclosed in U.S. Pat. No. 3,469,729 to R. B. Grekila et al.

As will be apparent from FIG. 2, an extensive seal area is provided and hence a much longer seal path to inhibit the diffusion of the discharge sustaining media through the seal area. The glassy sealing frit 66 extends between the edges of the aperture 54 in the end of the arc tube body and the tubulation, completely between the end of the arc tube body and the flat disc-shaped portion of the end cap and also for a substantial distance down the outside edge of the end of the arc tube body surrounded by the skirt portion of the end cap. Several lamps constructed in accordance with this invention and operated at higher than normal temperatures to provide improved color have operated for more than 10,000 hours without a lamp failure or a seal leak.

We claim:

1. A sealed high pressure sodium discharge lamp arc tube, said arc tube comprising:

an elongated monolithic alumina arc tube body having circular apertures in the ends thereof of a diameter substantially less than the diameter of the arc tube body;

a refractory metal end cap including a flat disc portion and a cylindrical skirt portion having refractory metal tubulation extending through the center thereof, said tubulation extending through said circular apertures in the ends of said arc tube body and said skirt portion of said end cap surrounding the end portions of the side wall of said arc tube body; and a glassy sealing frit disposed between the interior surface of said end cap and said arc tube body and between the portion of said tubulation extending through said circular apertures and the interior surfaces of said circular apertures.

2. The sealed high pressure sodium discharge lamp arc tube according to claim 1 wherein said end cap is niobium and said tubulation is niobium.

3. The sealed high pressure sodium discharge lamp arc tube according to claim 1 wherein said sealing frit principally comprises calcia and alumina.

4. A sealed high pressure sodium discharge lamp arc tube, said arc tube comprising:

an elongated monolithic alumina arc tube body having circular apertures in the ends thereof of a diameter substantially less than the diameter of the arc tube body;

a refractory metal end cap including a flat disc portion and a cylindrical skirt portion having refractory metal tubulation extending through the center thereof closing off each end of said arc tube body, said tubulation extending through said circular apertures in the ends of said arc tube body and said skirt portion of each of said end caps surrounding the exterior side walls adjacent each end of said arc tube body; and a glassy sealing frit disposed between the entire interior surface of said end caps and said arc tube body and between the portion of said tubulation extending through said circular apertures and the entire interior surface of said circular apertures.

5. The sealed high pressure sodium discharge lamp arc tube according to claim 4 wherein said end caps and said tubulation are niobium.

6. The sealed high pressure sodium discharge lamp arc tube according to claim 4 wherein said sealing frit principally comprises calcia and alumina.

* * * * *